US006126399A

United States Patent [19]

Bartley et al.

[11] Patent Number: 6,126,399

[45] **Date of Patent: *Oct. 3, 2000**

[54] FEATHERING PROPELLER

[76] Inventors: Bryan Allen Bartley, 625 Mt. Eden Road, Mt Eden, Auckland, New Zealand; John McKenzie Blundell, 35 Fern Glen Road South, St. Heliers, Auckland, New Zealand

[ * ] Notice: This patent issued on a continued prosecution application filed under 37 CFR 1.53(d), and is subject to the twenty year patent term provisions of 35 U.S.C. 154(a)(2).

[21] Appl. No.: 08/602,852

[22] PCT Filed: Sep. 14, 1994

[86] PCT No.: PCT/NZ94/00092

§ 371 Date: Jul. 12, 1996

§ 102(e) Date: Jul. 12, 1996

[87] PCT Pub. No.: WO95/07837

PCT Pub. Date: Mar. 23, 1995

[30] Foreign Application Priority Data

Sep. 14, 1993 [NZ] New Zealand ..... 248655

[51] Int. Cl.[7] ..... B63H 3/00; B63H 3/02

[52] U.S. Cl. ..... 416/137; 416/136; 416/140

[58] Field of Search ..... 416/44, 46, 136, 416/137, 140, 245 A; 440/50

[56] References Cited

U.S. PATENT DOCUMENTS

| | | | |
|---|---|---|---|
| 0,608,265 | 8/1898 | Olsen | 416/140 |
| 1,520,746 | 12/1924 | Boyce . | |
| 1,718,525 | 6/1929 | Casey . | |
| 3,099,321 | 7/1963 | Watts . | |
| 3,897,170 | 7/1975 | Darvishian | 416/140 |
| 4,058,360 | 11/1977 | Hirschberger . | |
| 5,232,345 | 8/1993 | Rocco . | |

FOREIGN PATENT DOCUMENTS

| | | |
|---|---|---|
| 3901672 | 8/1990 | Germany . |
| 2026100 | 1/1980 | United Kingdom . |
| 1566426 | 4/1980 | United Kingdom . |

*Primary Examiner*—Christopher Verdier
*Attorney, Agent, or Firm*—Ladas & Parry

[57] ABSTRACT

A featherable propeller assembly for fitment to a drive shaft has a blade carrying assembly which is carried by a hub assembly. The blade carrying assembly is rotatable relative to the hub assembly within relative limits of rotation. Blades are pivotally mounted on the blade carrying assembly. The relative rotation of the hub assembly and blade carrying assembly provides for different positions of respective stop abutments, thus allowing the blades to assume each of the following conditions: (a) a forward drive condition under a forward drive rotation of the shaft; (b) a feathering condition when not under drive from the shaft where the blades are substantially free to move into an orientation which is aligned with the flow of water past the propeller; and (c) a reverse driving condition under a reverse drive rotation of the shaft.

3 Claims, 4 Drawing Sheets

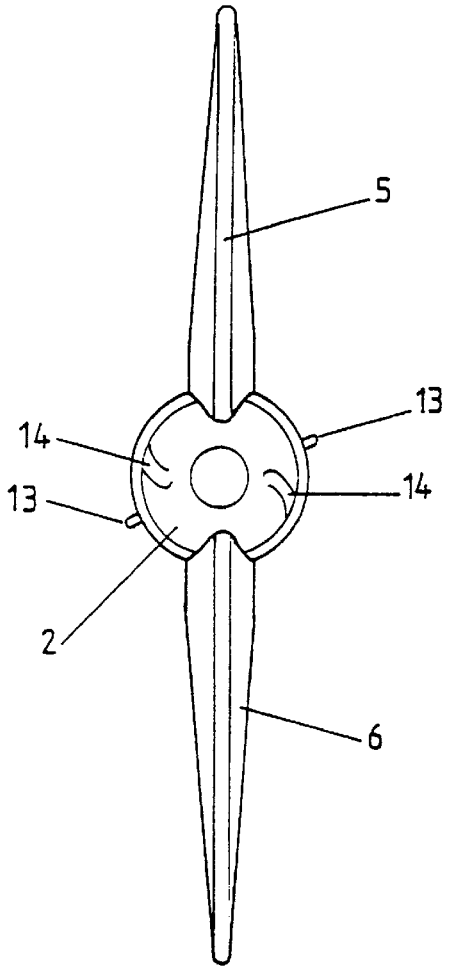
FIGURE 5
FIGURE 6
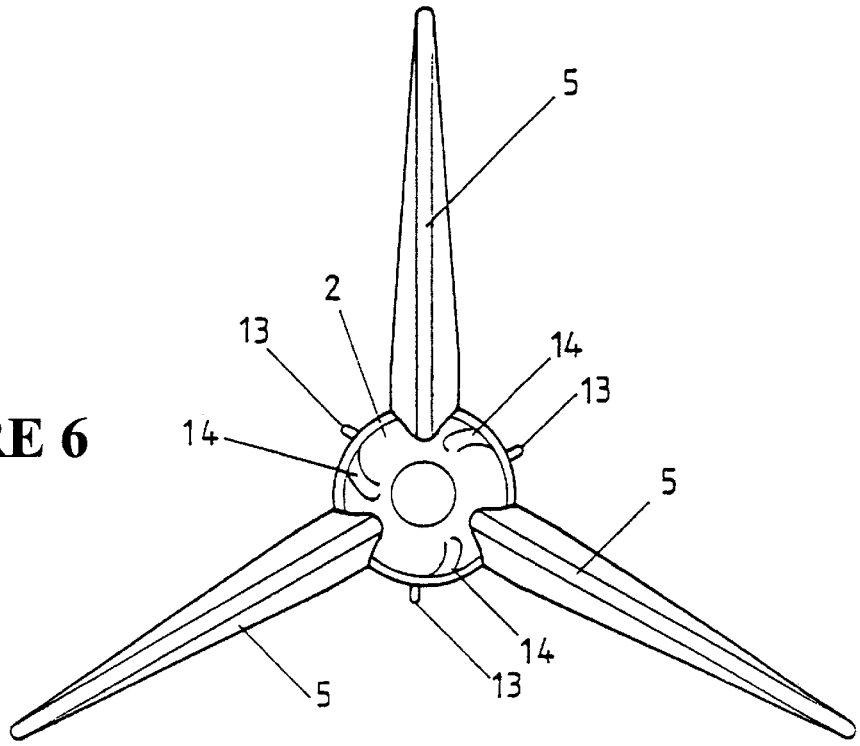

FEATHERING PROPELLER

FIELD OF THE INVENTION

The present invention relates to improvements in and/or relating to folding or feathering propellers.

BACKGROUND OF THE INVENTION

Folding or feathering propellers have been used in a number of, particularly, marine applications.

The ordinary folding propeller often used on cruising yachts has the propeller blades fold so as to provide low drag from the propeller when under sail. The disadvantage of such folding propellers (e.g. as disclosed in U.S. Patent Specification No. 4,086,025) is that the blades may not open when in ahead operation and can cause vibration if not perfectly aligned or true to each other. However, the most important detriment from this form of changing profile propeller is that motoring efficiency compared to a fixed blade propeller of the same diameter is about 70%. The same type of folding propeller in astern operation will not open to the maximum diameter due to the thrust on the blades balancing the centrifugal force holding the blades open with the result that seldom is more than 50% of the motoring efficiency achieved as compared to a fixed blade propeller of the same diameter.

In addition, these propellers require significant mass in the tips of the blades to provide the maximum centrifugal force thus constraining optimum blade design and causing vibration problems. In racing yachts this extra mass is a disadvantage.

To address the deficiencies of such folding propellers, a variety of different bladed propellers of a feathering kind have been proposed. Usually these are of two or three blades but can have more. Frequently such feathering propeller blades are fitted with a bevel pinion that engages a central cone gear driven by a shaft. Such arrangements tend to be complex notwithstanding their wide spread acceptance in the boating industry. Moreover, even in the feathered condition, the propeller and its shaft will auto-rotate, thereby increasing drag. An example of such a propeller is marketed under the trade mark "MAX-PROP"™ available in New Zealand from Marine Power and Service Limited, 50 Cook Street, Auckland 1, New Zealand.

Some feathering propellers are known, such as the propeller disclosed in U.S. Patent Specification 4,058,360, that have blades that, when fully feathered, are constrained by stops that hold the feathered blades in line with the shaft. Other feathering propellers such as the MAX-PROP™ cause the blades to turn to and from the pitch position by a bevel gear at the base of each blade engaged with a bevel gear on the propeller shaft. Thus the blades are geared together and only face in the same direction (are feathered) when they are in line with the shaft.

Blades feathered in that position may cause resistance or drag because, in practice, the flow of water is not commonly in line with the shaft. For example, in order for the propeller shaft to penetrate the hull surface and give adequate clearance for the propeller it is commonly angled down at an angle to the horizontal. Inclinations of between 10° and 20° are known.

Also common is a surface of the hull immediately above or adjacent the propeller which curves or slopes upwards. As fluid flowing along a surface tends to flow parallel to the surface, the water flow at or near the propeller is at an angle substantially similar to the angle of the adjacent hull surface.

For example, it is known to have a propeller shaft at an angle of 11° to the horizontal but the flow of water parallel to the hull at an angle of 17° to the shaft.

Further problems are encountered with sailing yachts which, when sailing against the wind, have the longitudinal centre line of the craft offset from the direction oftravel by 5° or more. This is caused by slippage.

Yet another example is the sailing of a boat in rough weather where the boat is caused to surge sideways with wave action which causes a flow of water across the line of, and therefore, substantially non-parallel to the propeller shaft.

When the blades in a feathered condition are substantially parallel to the propeller shaft and the flow of water is substantially not aligned or parallel with the shaft it will cause drag resistance and it may cause the propeller and shaft to auto-rotate, which can cause damaging wear and also indicates that the progress of the vessel is being resisted. This is particularly a problem with three bladed propellers but also occurs with two bladed propellers.

There is a need for an alternative to such gear dependent variable geometry propellers and particularly for feathering propellers and it is to this that the present invention is directed.

The present invention therefore offers an alternative form of propeller.

SUMMARY OF THE INVENTION

In a first aspect the present invention consists in a bladed featherable propeller assembly for fitment or fixed to a drive shaft, said assembly comprising:

- a hub member or assembly (hereafter "hub assembly") having-means enabling fitment to, or fitted to, said drive shaft so as to rotate with said drive shaft in each direction of rotation of said drive shaft,
- a member, members or assembly (hereafter "blade carrying assembly") carried by and/or axially located by said hub assembly relative to said drive shaft and rotatable relative to said hub assembly (and, in use, said drive shaft) within relative limits of movement, and
- at least one propeller blade pivotally mounted from said blade carrying assembly so as to be able to assume each of the following conditions:
  - (i) a forward driving condition under a forward drive rotation from a said drive shaft in use,
  - (ii) a feathering condition when not under drive from a said drive shaft in use as a result (at least in part) of a flow of water over the propeller blade, and
  - (iii) a reverse driving condition under a reverse drive rotation from a said drive shaft in use, wherein each of conditions (i) and (iii) have said propeller blade carrying assembly and hub assembly at a different said relative limit of movement,
- wherein said propeller blade in said feathering condition is substantially free to move onto an orientation which is substantially aligned with said flow of water past said blade carrying assembly.

Preferably said propeller blade, when in the feathering condition, has a range of movement of approximately + or −30° from the centre line of said drive shaft.

Preferably biasing means is provided between said hub assembly and said blade carrying assembly.

Preferably said biasing means biases said blade carrying assembly to one of said blade carrying assembly relative limits.

Preferably said biasing is out from reverse drive limits.

Preferably said one extreme of said relative limits is such that said propeller blade mounted from said blade carrying assembly is in a forward driving condition under a forward drive rotation from said drive shaft.

Preferably said biasing means is a coil spring.

Preferably said blade adjacent said blade carrying assembly is shaped so as to in use fit substantially closely to said hub member or assembly.

Preferably said distal end of said hub member or assembly is substantially hemispherical.

In a further aspect the invention consists in a bladed featherable propeller assembly for fitment or fitted to a drive shaft said assembly comprising:

a hub member or assembly (hereafter "hub assembly") having means enabling fitment to, or fitted to, a said drive shaft so as to rotate with the shaft about the shaft axis in each direction of rotation of the shaft;

a member, members or assembly (hereafter "blade carrying assembly") carried by and/or axially located by (relative to a said shaft in use) said hub assembly being rotatable relative to said hub assembly and, in use, said shaft within relative limits of movement; and at least one pivotally mounted propeller blade mounted from said blade carrying assembly;

the construction and arrangement being characterised in that:

(i) in a forward driving condition under a forward drive rotation from a said shaft in use, each propeller blade adopts a forward driving pitch by virtue of the trailing regions of the propeller blade causing said blade to move about its pivot with respect to said blade carrying assembly under water pressure to an abutment between said blade (or an extension thereof) and said blade carrying assembly precluding any further pivoting under water pressure while in the forward rotation direction of the propeller, (ii) a feathering condition when not under drive from a said shaft in use as a result (at least in part) of the flow of water over the blade causing the blade to pivot with respect to the blade carrying assembly (optionally with some relative movement within the relative limits by said blade carrying assembly relative to the hub assembly) to align with the water flow in a reduced drag condition, and wherein said blade (s), in the feathering condition, is (are) free to move over a range of angles with respect to the shaft centre line, and (iii) a reverse driving condition under a reverse drive rotation from a said shaft in use, wherein said hub assembly and said blade carrying assembly rotate to a different relative condition to that which they are in when in the forward driving condition thereby causing said trailing regions under a sliding and/or pivot-like (or functionally equivalent) abutment with said hub assembly rearwardly of said blade carrying assembly to pivot about said pivot of said blade with the blade carrying assembly so that said trailing regions of the blade are the leading edge of the blade in the reverse condition and/or the blade has thus been restored against the hydrodynamic forces acting on the blade to the same or similar position as it would occupy in the forward condition under hydrodynamic forces in isolation.

Preferably said range of said angles in (ii) is + or − about 30° from shaft centre line.

Preferably biasing means are included between said blade carrying assembly and said hub assembly.

Preferably said biasing means biases said blade carrying assembly to one extreme of said blade carrying assembly relative limits.

Preferably said biasing is out from the reverse drive limits.

Preferably said biasing means is a coil spring.

Preferably said blade adjacent said hub assembly is shaped so that said blade adjacent said hub assembly fits closely to said hub assembly.

Preferably said hub member has a substantially (hemi) spherical (distal) end.

Preferably said blade disposition (i.e. angle) about the pivotal mounting and relative to said shaft in use is substantially the same (eg within the same quadrant) in each of conditions (i) and (iii).

In yet a further aspect the invention consists in a bladed featherable propeller assembly for fitment or fitted to a drive shaft, said assembly comprising:

a hub member or assembly (hereafter "hub assembly") having means enabling fitment to, or fitted to, a said drive shaft so as to rotate with the shaft about the shaft axis in each direction of rotation of the shaft;

a member, members or assembly (hereafter "blade carrying assembly") carried by and/or axially located by (relative to a said shaft in use) said hub assembly being rotatable relative to said hub assembly and, in use, said shaft within relative limits of movement; and at least one pivotally mounted propeller blade mounted from said blade carrying assembly;

the construction and arrangement being characterised in that:

(i) in a forward driving condition under a forward drive rotation from a said shaft in use, each propeller blade adopts a forward driving pitch by virtue of the trailing regions of the propeller blade causing said blade to move about its pivot with respect to said blade carrying assembly under water pressure to an abutment between said blade (or an extension thereof) and said blade carrying assembly precluding any further pivoting under water pressure while in the forward rotation direction of the propeller, (ii) a feathering condition when not under drive from a said shaft in use as a result (at least in part) of the flow of water over the blade causing the blade to pivot with respect to the blade carrying assembly (optionally with some relative movement within the relative limits by said blade carrying assembly relative to the hub assembly) to align with the water flow in a reduced condition, and wherein said blade(s), in the feathering condition, is (are) free to move over a range of angles with respect to the shaft centre line, and (iii) a reverse driving condition under a reverse drive rotation from a said shaft in use, wherein torque applied to said shaft causes the blade carrying assembly to rotate about the hub assembly to the reverse rotation stop.

Preferably said range of said angles in (ii) is + or − about 30° from shaft centre line.

Preferably biasing means are included between said blade crying assembly and said hub assembly.

Preferably said biasing means biases said blade carrying assembly to one extreme of said blade carrying assembly relative limits.

Preferably said biasing is out from the reverse drive limits.

Preferably said biasing means is a coil spring.

Preferably said blade adjacent said hub assembly is shaped so that said blade adjacent said hub assembly fits closely to said hub assembly.

Preferably said distal end of said hub member or assembly is substantially (hemi) spherical.

In yet another aspect the present invention consists in a bladed featherable propeller assembly for fitment or fined to a drive shaft, said assembly comprising:

a hub member or assembly (hereafter "hub assembly") having means enabling fitment to, or fitted to, a said drive shaft so as to rotate with the shaft about the shaft axis in each direction of rotation of the shaft;

a member, members or assembly (hereafter "blade carrying assembly") carried by and/or axially located by (relative to a said shaft in use) said hub assembly being rotatable relative to said hub assembly (and, in use, said shaft) within relative limits of movement, and at least one pivotally mounted propeller blade mounted from said blade carrying assembly so as to be able to assume each of the following conditions:

(i) a forward driving condition under a forward drive rotation from a said shaft in use, (ii) a feathering condition when not under drive from a said shaft in use as a result (at least in part) of the flow of water over the blade, and (iii) a reverse driving condition under a reverse drive rotation from a said shaft in use, wherein each of conditions (i) and (iii) have said blade carrying assembly and hub assembly at a different said relative limit of movement, wherein biasing means is provided between said hub assembly and said blade carrying assembly.

Preferably said propeller blades, when in the feathering condition ie. (ii), have a range of movement of approximately + or −30° from the shaft centre line.

Preferably said biasing means biases said blade carrying assembly to one extreme of said blade carrying assembly relative limits.

Preferably said biasing is out from the reverse drive limits.

Preferably said extreme of said relative limits is such that said propeller blade mounted from said blade carrying assembly can turn to the forward driving condition under a forward drive rotation from said shaft and the pressure of water against the blade in use.

Preferably said blade (ie. portion of said blade member) adjacent said hub assembly is shaped so that said portion of said blade adjacent sad hub member fits substantially closely.

Preferably said bladed featherable propeller is substantially as hereinbefore described.

Preferably the distal end of said hub member is substantially (hemi) spherical.

In yet another aspect the present invention consists in a bladed featherable propeller assembly for fitment or fitted to a drive shaft, said assembly comprising:

a hub member or assembly (hereafter "hub assembly") having means enabling fitment to, or fitted to, a said drive shaft so as to rotate with the shaft about the shaft axis in each direction of rotation of the shaft, a member, members or assembly (hereafter "blade carrying assembly") carried by and/or axially located by (relative to a said shaft in use) said hub assembly being rotatable relative to said hub assembly (and, in use, said shaft) within relative limits of movement, and at least one pivotally mounted propeller blade mounted from said blade carrying assembly so as to be able to assume each of the following conditions:

(i) a forward driving condition under a forward drive rotation from a said shaft in use, (ii) a feathering condition when not under drive from a said shaft in use as a result (at least in part) of the flow of water over the blade, and (iii) a reverse driving condition under a reverse drive rotation from a said shaft in use, wherein each of conditions (i) and (iii) have said blade carrying assembly and hub assembly at a different said relative limit of movement, wherein said blade(s) adjacent said blade carrying assembly is (are) shaped so as to, in use, fit substantially closely to said blade carrying assembly.

Preferably said bladed featherable propeller is substantially as hereinbefore described.

In some forms of the invention the "hub assembly" may carry the blade carrying assembly between spaced parts thereof (to prevent substantial axial displacement relative to a said drive shaft), the blade carrying assembly having a bearing type association with said shaft Indeed the shaft could use a shoulder to coact with a form of hub assembly to "sandwich" axially (relative to the shaft) the propeller carrying member.

Preferably, as described hereinafter, the hub assembly is also interposed between said blade carrying assembly and either the shaft or the axis of the shaft.

Preferably said blade carrying assembly carries two or three blades but can if desired carry more.

Preferably said stop or other means of outwardly directed protrusion is from the blade carrying assembly to the hub assembly itself, the blade carrying assembly preferably being in the form of a collar held relative thereto between the appropriate rotational relationship i.e. at its appropriate limit.

Preferably the arrangement is substantially as hereinafter described with reference to any of the accompanying drawings.

In yet a further aspect the present invention consists in a bladed featherable propeller assembly substantially as hereinafter described with reference to any one or more of the accompanying drawings.

In yet a further aspect the present invention consists in combination a propeller assembly in accordance with the present invention and a shaft engaged with said hub assembly thereof.

Preferably said shaft is that of a boat.

The propeller can be for either right or left handed drive rotations, i.e. handedness forms no part of the invention.

The invention consists in the foregoing and also envisages constructions of which the following gives examples.

BRIEF DESCRIPTION OF THE DRAWINGS

Preferred forms of the present invention will now be described with reference to the accompanying drawings in which:

FIG. 5 shows a form of the invention having 2 blades mounted on the hub; and FIG. 6 shows a form of the invention having 3 blades mounted on the hub.

DETAILED DESCRIPTION

Figure 1:
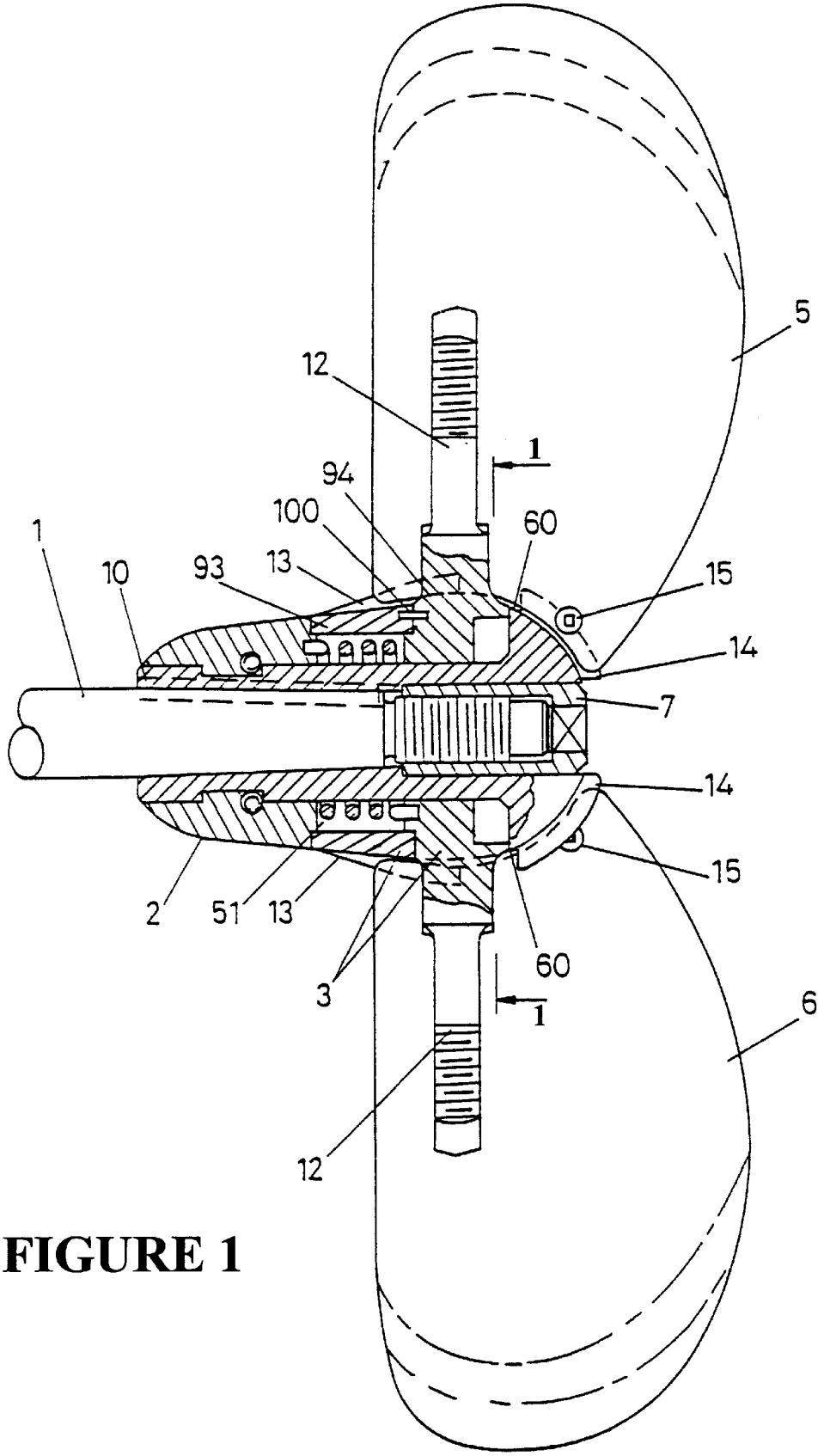
FIG. 1 is a side sectional view through the section 1—1 shown in FIG. 2.

In a form of the present invention a hub assembly 2 is mounted directly or indirectly on a drive shaft 1. In preferred forms of the invention this is the propeller shaft of a boat and preferably a yacht. In use, a blade carrying assembly 3 is carried and/or axially located relative to shaft 1 by said hub assembly 2. In preferred forms of the invention the hub assembly 2 is fixed on shaft 1 by means of a key 10 and shaft nut 7.

However other forms of fixing are envisaged Preferably the nut 7 is locked with a split pin (not shown) between the nut and the hub assembly.

The blade carrying assembly 3 is rotatable relative to said hub assembly 2 and, therefore said shaft 1 within relative limits of movement. The limits of movement may be provided by for example a dog clutch or other means of limiting the relative motion of one member to another.

Blades 5 and shafts 12 may have a screw thread to allow forced rotation of the blade while restraining the blades centrifuigally.

Mounted from said blade carrying assembly 3 in a form of the invention as shown in, for X- example FIG. 5, are two propeller blades 5 and 6. The said propeller blades may be mounted from said blade carrying assembly by means of shafts or pins 12. In other forms of the invention there may be three blades, as shown in FIG. 6, or more blades. The provision of more blades limits the amount of movement available to the blades when in the feathered condition, this may provide a limit on the number of blades which are desirable.

In preferred forms of the invention the ends of the propeller blades 5 and 6 adjacent the hub assembly 2 and blade carrying assembly 3, which is also the area of the blades 5 and 6 adjacent the pin or shaft 12, is shaped so as to fit closely against said hub assembly 2 and/or said blade carrying assembly 3. Present on said hub assembly 2, are in one form of the present invention, abutments 14. These abutments provide a pivot about which the blades 5 and 6 rotate and slide into the reverse position. These abutments may be in the form of pins or extensions of the hub assembly 2. The abutments 14 may or may not be adjustable. For example, the abutments 14 may take the form of a nut attached to a threaded stud, whereby the provision of different sized nuts adjusts the abutment 14. If the abutment is in the form of a pin it may be repositioned so as to provide adjustment.

Figure 4:
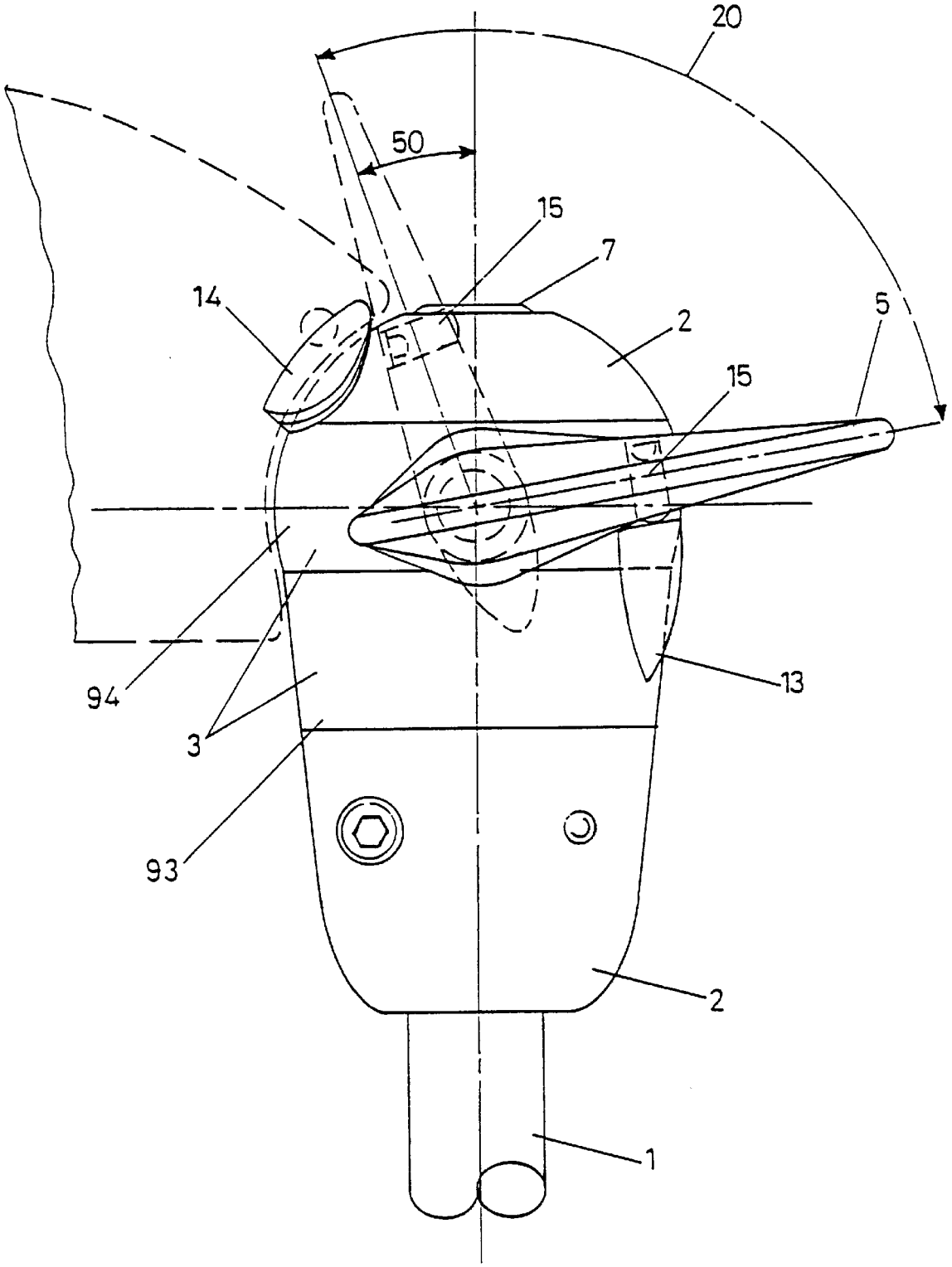
FIG. 4 shows a plan view of a propeller of the present invention on a shaft.

As can be seen in FIG. 4 the abutments 14 are shaped and configured so as to provide a gap 50 between the propeller blades 5 and 6 in the condition wherein the blades are fully in line with the shaft and the position wherein the blades 5 and 6 abut said abutments 14. This gap 50 allows the propeller blades 5 and 6 some freedom of rotation so that, they are able, within the limits provided by the abutments 14, to pivot so as to be substantially aligned with the direction of fluid flow over said blades.

Figure 2:
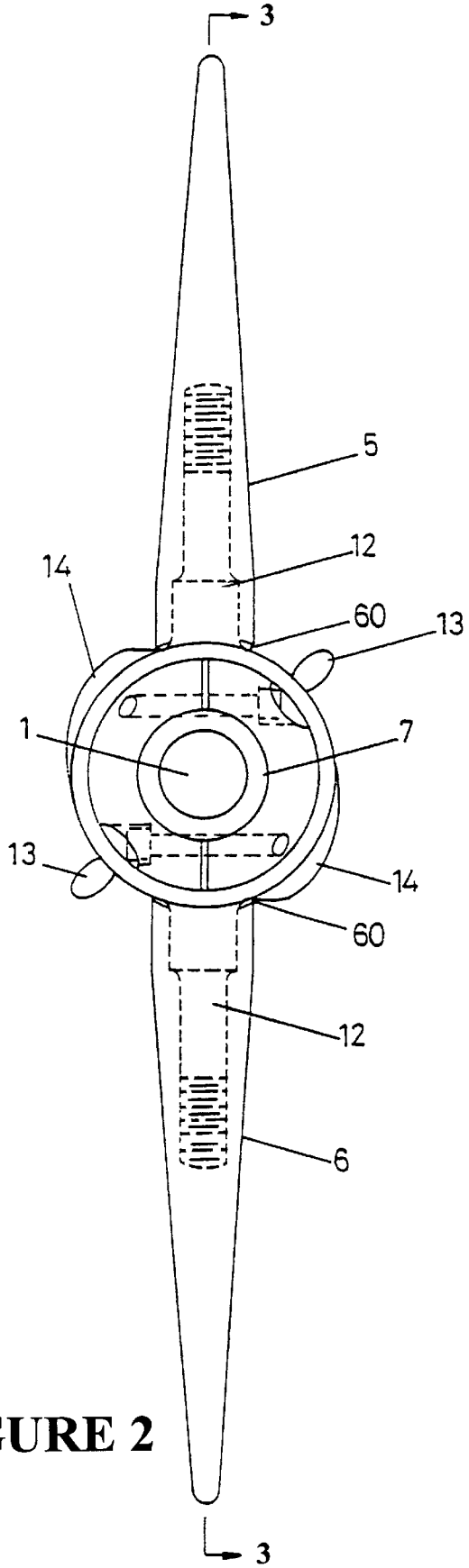
FIG. 2 is a front view of the feathered propeller of FIG. 1.

In a form of the present invention as shown in FIGS. 2 and 4 stops 13 are provided. These stops are provided on the blade carrying assembly 3 and define the stop position for the blade in the forward and/or reverse driving positions. In some forms of the invention these stops 13 may be adjustable by, for example, the use of pins insertable into a variety of holes, or other forms of adjustable or moveable stops. For example, in the form of the invention as shown in the figures the blade carrying assembly 3 consists of two members 93 and 94. The members 93 and 94 are joined and held in position relative to each other by pin 100 (FIG. 1). In other forms of the invention the members 93 ad 94 may be repositioned relative to each other, thus repositioning the stops 13 by relocating the pin 100. The relationship between the blades 5 and 6 and the stops 13 may also be made adjustable by a grub screw 15 within each of the blades. Each grub screw 15 may be self locking in the preferred form of the invention, which utilises nylon blades. The pitch of any blade, when in the forward driving condition is therefore adjustable, by means of changing the protruding length of screw 15.

Figure 3:
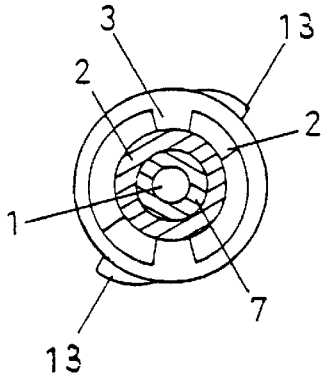
FIG. 3 is the section looking forward with respect to 3—3 shown in FIG. 1.

The limits to the relative movement of the blade carrying assembly 3 about the hub assembly 2 is, in one form of the present invention, provided for by a dog clutch arrangement between said blade carrying assembly 3 and said hub member 2. This is as shown in FIG. 3 which is a sectional view through 3—3 of FIG. 1.

FIG. 1 is a sectional side view of one form of the present invention wherein a biasing means 51 is provided between said hub assembly 2 and said blade carrying assembly 3. This biasing means 51 is a coil spring ad biases the relative movement between the hub assembly 2 and the blade carrying assembly 3 to one extreme of the relative motion provided for by the dog clutch between said hub assembly 2 and said blade carrying assembly 3. Thus the propeller blades 5 ad 6 are biased towards the forward driving condition.

In preferred forms of the invention the biasing means 51, which is in the form of a coil spring, is produced from corrosion protected steel.

It can be seen in at least FIGS. 1 and 2 that the blades 5 and 6 are shaped so that the gap 60 between said blades and said hub assembly 3 is small. The gap 60 must of course be sufficiently large so as to allow the blades 5 and 6 to rotate freely and also allow the blades to pass over any irregularities that may be present on the hub assembly and/or blade carrying assembly. In an especially preferred form of the invention the end of the hub assembly 2 is substantially hemispherical and the portion of the blades or blade assemblies 5 and 6 adjacent the hub or hub assembly 2 are thus substantially semicircular.

The hub and blade assemblies and the various stops and abutments are preferably produced from suitable corrosion protected or resistant materials which are known in the art to which the invention relates. In forms of the invention the propeller blades may be made from a suitable grade of nylon.

FIG. 4 is a plan view of one form of the invention shown in FIG. 1. The blade 5 is free to swing in the arc 20 between the pitch stop 13 and the abutment 14. Thus when not being driven in either forward or reverse directions by the shaft 1 it is free to align with the water flow which does not necessarily align with the shaft 1.

What is claimed is:

1. A bladed featherable propeller assembly comprising:

a hub assembly having means for fitment to a drive shaft having a longitudinal rotational axis so as to rotate with said drive shaft in forward and reverse directions of driven rotation of said drive shaft about said longitudinal rotational axis;

a blade carrying assembly carried by said hub assembly, said blade carrying assembly being rotatable relative to said hub assembly within limits; and two or more propeller blades pivotally mounted from said blade carrying assembly on respective pivots substantially normal to said longitudinal rotational axis for assuming in water without internal gear meshing each of the following conditions:

(i) a forward driving condition from said forward direction of driven rotation of said drive shaft, said forward driving condition defining a pitch stop position with trailing edges on said propeller blades, (ii) a feathering condition without said driven rotation of said drive shaft wherein each of said propeller blades can pivot independently on said respective pivots through a range of feathered angles, and (iii) a reverse driving condition from said reverse direction of driven rotation of said drive shaft, wherein said trailing edges are leading edges in said reverse driving condition, wherein said forward and reverse driving conditions have said blade carrying assembly at respective of said limits, wherein, in at least one of said forward and reverse driving conditions, said propeller blades have respective portions spaced from said respective pivots abutted against said hub assembly or blade carrying assembly, wherein said range of feathered angles is approximately + or −30° from said longitudinal rotational axis, and wherein biasing means is provided between said hub assembly and said blade carrying assembly.

2. A bladed featherable propeller assembly comprising:

a hub assembly having means for fitment to a drive shaft having a longitudinal rotational axis so as to rotate with said drive shaft in forward and reverse directions of driven rotation of said drive shaft about said longitudinal rotational axis;

a blade carrying assembly carried by said hub assembly, said blade carrying assembly being rotatable relative to said hub assembly within limits; and two or more propeller blades pivotally mounted from said blade carrying assembly on respective pivots substantially normal to said longitudinal rotational axis for assuming in water without internal gear meshing each of the following conditions:

(i) a forward driving condition from said forward direction of driven rotation of said drive shaft, said forward driving condition defining a pitch stop position with trailing edges on said propeller blades, (ii) a feathering condition without said driven rotation of said drive shaft wherein each of said propeller blades can pivot independently on said respective pivots through a range of feathered angles, and (iii) a reverse driving condition from said reverse direction of driven rotation of said drive shaft, wherein said trailing edges are leading edges in said reverse driving condition, wherein said forward and reverse driving conditions have said blade carrying assembly at respective of said limits, wherein, in at least one of said forward and reverse driving conditions, said propeller blades have respective portions spaced from said respective pivots abutted against said hub assembly or blade carrying assembly, and wherein said pitch stop position of said forward driving condition is adjustable by grub screws respectively passing through said propeller blades and bearing against respective pitch stops.

3. A bladed featherable propeller assembly as claimed in claim 1 wherein said pitch stop position of said forward driving condition is adjustable by grub screws respectively passing through said propeller blades and bearing against respective pitch stops.

* * * * *